US009156589B2

(12) United States Patent
Fernandez de Castro

(10) Patent No.: US 9,156,589 B2
(45) Date of Patent: Oct. 13, 2015

(54) MANUALLY ACTIVATED RECONSTITUTING CONTAINER

(76) Inventor: Alberto Fernandez de Castro, Miami, FL (US)

( * ) Notice: Subject to any disclaimer, the term of this patent is extended or adjusted under 35 U.S.C. 154(b) by 55 days.

(21) Appl. No.: 13/086,865

(22) Filed: Apr. 14, 2011

(65) Prior Publication Data

US 2011/0253564 A1 Oct. 20, 2011

Related U.S. Application Data

(60) Provisional application No. 61/324,480, filed on Apr. 15, 2010.

(51) Int. Cl.
*B65D 81/32* (2006.01)
*B65D 25/08* (2006.01)

(52) U.S. Cl.
CPC ..... *B65D 25/08* (2013.01)

(58) Field of Classification Search
CPC ..... A61J 1/2089
USPC ..... 206/222, 219; 220/666, 23.86, 23.83, 220/501; 215/6; 604/90, 416
See application file for complete search history.

(56) References Cited

U.S. PATENT DOCUMENTS 3,321,097 A * 5/1967 Solowey ..... B65D 1/04 206/221
3,521,745 A * 7/1970 Schwartzman .... B65D 81/3211 206/222
3,696,919 A * 10/1972 Miles ..... B65D 81/3222 206/221
4,174,035 A * 11/1979 Wiegner ..... B65D 81/3222 206/222
4,247,001 A * 1/1981 Wiegner ..... B65D 81/3222 206/222
4,483,439 A * 11/1984 Steigerwald ..... B65D 81/3216 206/219
4,548,606 A 10/1985 Larkin
4,875,576 A * 10/1989 Torgrimson ..... B65D 85/816 206/218
5,071,034 A * 12/1991 Corbiere ..... A61J 1/2089 206/222
5,114,411 A * 5/1992 Haber ..... A61J 1/2089 604/203
5,170,888 A 12/1992 Goncalves
5,275,298 A * 1/1994 Holley, Jr. ..... A47J 43/27 206/221
5,353,961 A 10/1994 Debush
5,383,579 A * 1/1995 Lanfranconi ..... A61J 1/2093 222/129
5,384,138 A * 1/1995 Robbins, III ..... B29C 53/08 215/10
5,419,445 A * 5/1995 Kaesemeyer ..... A61J 1/2093 206/220
5,514,394 A * 5/1996 Lenahan ..... B65D 5/48024 206/219

(Continued)

FOREIGN PATENT DOCUMENTS

CN 1827359 A 9/2006
CN 2824926 Y 10/2006

(Continued)

OTHER PUBLICATIONS

International Search Report and Written Opinion for PCT/US2011/032496 mailed Dec. 27, 2011, 10 pages.

*Primary Examiner* — Anthony Stashick
*Assistant Examiner* — King M Chu
(74) *Attorney, Agent, or Firm* — Luis Figarella

(57) ABSTRACT

The invention relates to single chamber containers with internal indentions upon which flexible seals are placed to form separate compartments. Between these compartments is a contractible section upon which a cutting ring is welded. By applying pressure downward from the top, the contractible area retracts and the cutting ring reaches and pierces the seal. After a quick agitation, the consumer simply opens the discharge end and is ready to enjoy an instantly made beverage.

14 Claims, 8 Drawing Sheets

(56) References Cited

U.S. PATENT DOCUMENTS

| | | | | |
|---|---|---|---|---|
| 5,638,968 | A | 6/1997 | Baron et al. | |
| 5,685,846 | A | 11/1997 | Michaels, Jr. | |
| 5,860,569 | A * | 1/1999 | Gregoire | B65D 25/087 222/129 |
| 6,068,396 | A * | 5/2000 | Baudin | B65D 25/085 206/219 |
| 6,367,622 | B1 | 4/2002 | Hsu | |
| 6,641,307 | B2 | 11/2003 | Matsuda et al. | |
| 6,705,462 | B2 * | 3/2004 | Kasuya | B65D 25/08 206/222 |
| D587,599 | S | 3/2009 | Steltenkamp | |
| 7,607,549 | B2 * | 10/2009 | Morini | B65D 41/3438 206/219 |
| 8,151,985 | B2 * | 4/2012 | Owoc | B65D 25/08 206/219 |
| 8,631,933 | B2 * | 1/2014 | Lee | B65D 47/243 206/219 |
| 2004/0134802 | A1 * | 7/2004 | Inoue | A61J 1/2093 206/219 |
| 2005/0016874 | A1 * | 1/2005 | Serra Galdos | B65D 25/082 206/219 |
| 2005/0098526 | A1 | 5/2005 | Catalin | |
| 2006/0021996 | A1 | 2/2006 | Scott et al. | |
| 2006/0032782 | A1 * | 2/2006 | Suh | A45C 7/0086 206/581 |
| 2006/0049127 | A1 * | 3/2006 | Katz | B65D 81/3211 215/6 |
| 2006/0189943 | A1 | 8/2006 | Kato et al. | |
| 2007/0278114 | A1 * | 12/2007 | Kane | B65D 25/08 206/219 |
| 2008/0302751 | A1 | 12/2008 | Segovia, Jr. | |
| 2009/0133366 | A1 | 5/2009 | Cronin et al. | |
| 2009/0182301 | A1 | 7/2009 | Bassarab et al. | |
| 2010/0112146 | A1 * | 5/2010 | Zoss | B65D 25/04 426/115 |
| 2010/0126888 | A1 * | 5/2010 | Lee | B65D 25/08 206/219 |
| 2010/0197542 | A1 * | 8/2010 | Talamonti | A01N 25/34 510/119 |
| 2011/0056853 | A1 * | 3/2011 | Cheetham | A61C 5/064 206/219 |
| 2011/0100844 | A1 * | 5/2011 | Cimaglio | B65D 81/3266 206/219 |
| 2011/0150952 | A1 * | 6/2011 | Simonnet | A61K 8/604 424/401 |
| 2014/0004227 | A1 * | 1/2014 | Tran | A45D 37/00 426/66 |

FOREIGN PATENT DOCUMENTS

| | | | |
|---|---|---|---|
| CN | 2887304 | Y | 4/2007 |
| CN | 2905671 | Y | 5/2007 |
| CN | 101433498 | A | 5/2009 |
| EP | 1479449 | A2 | 11/2004 |
| HU | 0600909 | | 3/2009 |
| KR | 20040100930 | | 12/2004 |
| WO | WO-9204236 | A1 | 3/1992 |
| WO | WO-2008075975 | A2 | 6/2008 |

* cited by examiner

MANUALLY ACTIVATED RECONSTITUTING CONTAINER

PRIORITY CLAIM

This application claims priority to and the benefit of U.S. Provisional Patent Application Ser. No. 61/324,480, filed on Apr. 15, 2010, the disclosure of which is hereby incorporated herein by reference in its entirety.

FIELD OF THE INVENTION

The present invention relates generally to containers for delivering shelf stable food products to consumers and, more specifically, to single chamber containers, such as beverage containers, subdivided into sealed portions for segregating at least two components, such as liquid and solid components.

BACKGROUND OF THE INVENTION

Several decades ago, aseptic beverage products came into the marketplace to fulfill the necessity of providing consumers with shelf-stable beverages that required no refrigeration. This new product line was based on the sterilization of liquids and their storage in newly developed multi-layered disposable cartons. The process was designed to sterilize and hold basic fluid beverages like juices and milk in disposable cartons, for extended periods of time without the need of refrigeration. Although the new technology did enable beverages to remain without refrigeration for months, the higher cost of both the process and the cartons, together with the degradation of the nutrients and vitamins due to the exposure of the liquids to high temperatures during packaging, limited the products' success to secondary markets around the globe, where the refrigerated supply chain was not dependable.

But, this created a paradox to this day. A high cost vitamin deficient solution became the only shelf-stable alternative for emerging markets, where the consumer's purchasing power is limited and the need for higher nutrition imperative.

To address consumer acceptance, nutrition, non-refrigeration, low cost and other issues, various multi-compartment containers have been developed that allow consumers to mix the components immediately prior to consumption. One type of container, for example, uses caps/closures that are filled with a first component and placed on the top of a bottle filled with a second component. By pressing down on this type of closure, the bottom of the cavity breaks open and its contents are dropped into the second component below containing, for example, water. Although this method can avoid the thermal processes of sterilization, it has not achieved success in the market because, first, the internal cavity that holds the separate component is small and thus can only be used for concentrated powders, and second, it is very expensive. The cost of a PET bottle, the cap filling process, and the cap/closure itself, result in a very high cost packaging solution. Moreover, the actual product dispenses the liquid with awkward fluidity through the same area of the closure that can get contaminated during activation (e.g., when pressed by an un-sanitized thumb).

Many other attempts to developing a multi-sectional container have been made. These include bottles within bottles, plastic bags within a bottle, caps with plunger mechanisms, "screw on" bottle sections, and parallel containers sharing the same closure, just to mention a few. Yet, many have been unsuccessful in the marketplace due to production complications, high costs, functionality issues, limited applications and just simple inconvenience.

Accordingly, there exists a need in the art for a reliable, cost-effective container and associated method for providing shelf stable beverages and other comestibles to consumers around the world.

SUMMARY OF THE INVENTION

The present invention addresses the deficiencies of the prior art, such as providing a single container that can be made with most plastics (e.g., LDPE, HDPE, PE, PET, PLA, etc.), providing unlimited cavity sizes for both internal portions so larger volume ingredients such as milk powder can be stored, and manufacturing at a cost significantly lower than aseptic packaging.

The prior art describes expensive, complicated plunger mechanisms and/or a variety of dispensing closures/caps. The prior art does not appear to achieve any of the principal goals of the invention, including low cost, a single piece container, and a configuration that can be safely and easily mass produced. This invention is therefore appealing to both the high quality market segment, because of its product freshness, and the price sensitive segment, because of its low cost.

One embodiment of the invention consists of a single container (such as a recyclable plastic bottle) where one or more inner circumferential indentions form surface areas to which one or more inductable seals are placed to form separate compartments or portions. Also separating these portions are several parallel circumferential folds that encircle the container creating a contractible, weaker section, to which a cutting ring (or piercing mechanism) is internally attached. Moreover, the invention can be seen as one single container with a contractible or compressible section upon which on one side a cutting mechanism is attached and on the other a frangible seal. By pressing the sections together, the contractible section contracts and the cutting section reaches and pierces the frangible seal.

Embodiments of this invention relate to an inexpensive, non-refrigerated package, where the ingredients are suspended intact with all their nutritional properties for extended periods of time, until mixed by the end consumer. In one embodiment, for example, after the seals are placed when the container is filled, activation (or the mixing of the ingredients) happens when the consumer presses downward on the container. This downward pressure shortens the distance between the seal and the cutting ring, thus permitting the cutting section to reach and breach the seal.

According to one aspect, the present invention relates to a container for delivery of segregated shelf stable components in a single chamber to a user. The container includes a first container portion adapted to receive a first component and a second container portion adapted to receive a second component. A frangible seal is disposed therebetween to prevent inadvertent mixing of the first component and the second component. The container further includes a structural feature for breaching the seal, actuated by displacement of the first container portion toward the second container portion. In one embodiment, the container includes a flexible wall section joining the first container portion with the second container portion. The flexible wall section may resemble a bellows. Depending on the particular configuration, the seal can be affixed to the bellows or another portion of the container proximate the bellows. In various embodiments, the seal breaching feature may include an edge for puncturing the seal and the seal breaching feature may be affixed to the first container portion. In some embodiments, the edge is circumferentially disposed and the seal breaching means may form a discontinuity in the edge. In other embodiments, the seal breaching means includes a piercing member for puncturing the seal. The piercing member may be generally centrally disposed, and may be supported by a plurality of radially disposed edges. Various types of components may fill the container portions, such as liquids, gels, powders, granules, solids, and blends thereof. In general, these components will be referred to herein below generally as liquids and powders. In one embodiment, a volume defined by the first container portion may be substantially greater than a volume defined by the second container portion. The container may optionally include an element to prevent breaching of the seal due to inadvertent displacement of the first container portion toward the second container portion, such as a circumferentially disposed removable band.

In accordance with one particular embodiment, a substantially cylindrical container for delivery of segregated shelf stable liquid and solid components in a single chamber to a user includes an upper container portion housing the solid component and a larger volume lower container portion housing the liquid component. A flexible wall portion is disposed therebetween, including a frangible disk seal to prevent inadvertent mixing of the solid component and the liquid component. An annular cutter is affixed to the container for breaching the seal, and is actuated by displacement of the upper container portion and the lower container portion toward each other.

According to another aspect of the invention, a method of providing a shelf stable product to a user in a single chamber container entails delivering segregated components in the single container until combined by the user. The method includes the steps of dispensing and sealing a first component in a first portion of the container with a frangible seal and dispensing and sealing a second component in a second portion of the container bounded at least in part by the frangible seal. The container includes a structural feature for breaching the seal, actuated by displacement of the first container portion toward the second container portion. In one embodiment, the method includes the steps of displacing the first container portion toward the second container portion to breach the frangible seal and agitating the container to mix the first component and the second component.

In one embodiment, the breached seal remains affixed to the container. The method optionally includes the step of removing an obstruction to permit displacement of the first container portion toward the second container portion. A final step may include the step of unsealing the second portion of the container to dispense the mixed components.

BRIEF DESCRIPTION OF THE FIGURES

Other features and advantages of the present invention, as well as the invention itself, can be more fully understood from the following description of the various embodiments, when read together with the accompanying drawings, in which.

DETAILED DESCRIPTION OF THE INVENTION

The invention may be better understood by reference to the following detailed description, taken in conjunction with the drawings. The present invention has been initially developed as a single container with separate internal indentions that serve as surface areas for a seal and a cutting mechanism. In between the indentions for the seal and the cutting mechanism, is a contractible section that, upon activation, brings both elements together (i.e., the cutting mechanism to the seal) to breach the seal, thus enabling the ingredients to mix freely. Other configurations and variants will be apparent to those skilled in the art from the teachings herein.

Figure 1:
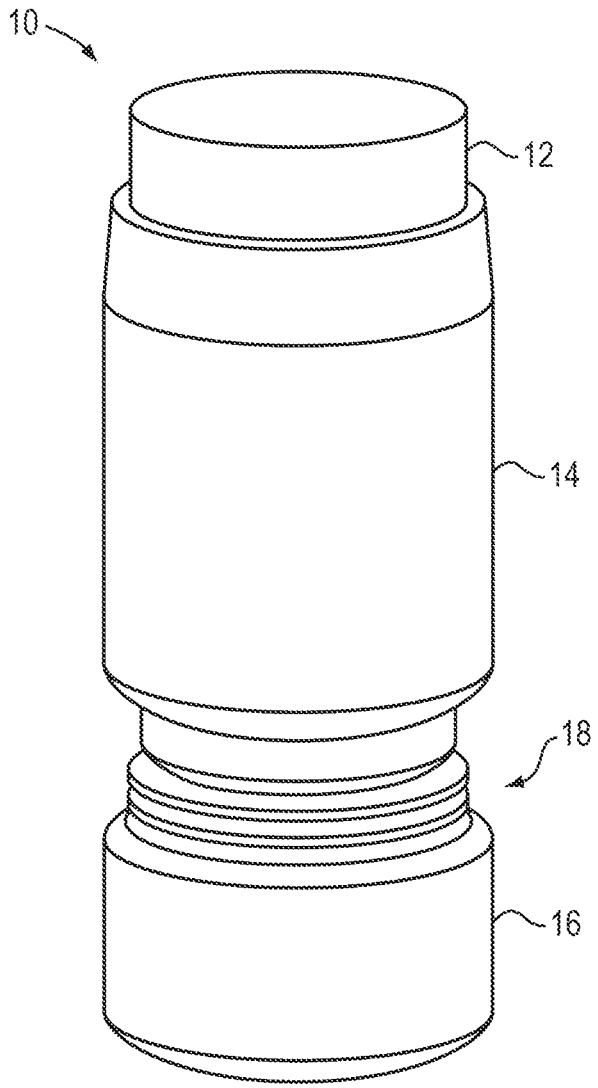
FIG. 1 is a schematic side view of a container in accordance with one embodiment of the invention.

FIG. 1 depicts a container 10 in accordance with one embodiment of the invention and demonstrates a general shape of one typical embodiment. Its major components include a lid or liner 12 used to cap a discharge section, a first container portion 14 for storing liquids or powders, a second container portion 16 for storing liquids or powders, and a contractible section 18 disposed therebetween.

While FIG. 1 depicts a generally cylindrical container 10, it will be readily understood by those skilled in the art that the particular shape of the container is not necessarily limiting, and the teachings herein can be applied to containers of different shapes and configurations to achieve the heretofore unknown benefits described herein.

Figure 2:
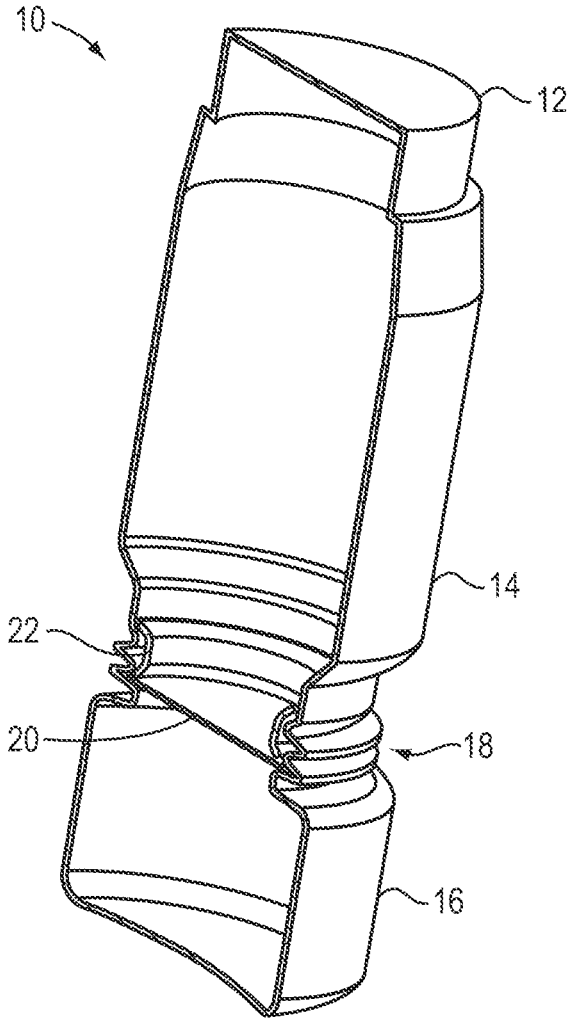
FIG. 2 is a schematic cross-sectional interior view of the container of FIG. 1 in accordance with one embodiment of the invention.

FIG. 2 depicts additional interior components of the container 10. In this particular embodiment, the container 10 includes the following components: a sealed liner, closure or lid 12 to cap the discharge section, a first compartment or portion 14 above a frangible seal 20, a second compartment or portion 16 below the frangible seal 20, and a cutting ring 22 affixed to the internal collapsible section 18. For this embodiment, the first portion 14 is depicted with a larger volume than the lower portion 16. However, it is readily understood that due to the nature of the design, in further embodiments the volumetric relationship can be equal or opposite.

The cutting ring 22 and inducted film seal 20 are exposed in this view. This view clearly depicts the welded cutting ring 22 placed above the contractible section 18 opposite the frangible seal 20. Their relationship can be inverted. Alternatively or additionally, the cutting ring 22 can be replaced by another structure configured to cut or pierce the seal 20, including one having a pointed or blunt edge or other type of feature. In this specific embodiment, induction and ultrasonic welding are used to attach the seal 20 and the cutting ring 22 to the container 10; however, other bonding techniques including adhesive bonding, heat sealing, interference friction fit, integral forming, etc. may be employed.

Figure 3:
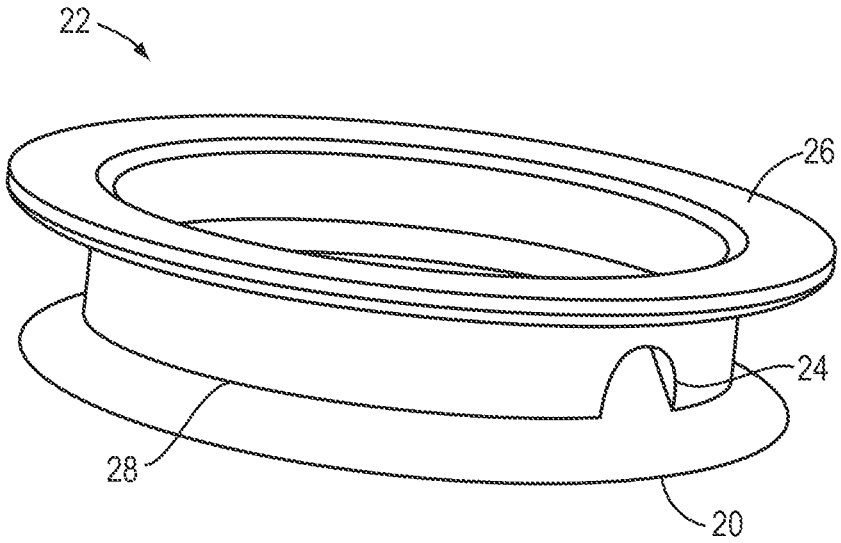
FIG. 3 is an enlarged schematic perspective view of one embodiment of a seal cutting ring for use with the container of FIG. 1 in accordance with one embodiment of the invention.

FIG. 3 depicts an enlarged schematic perspective view of one embodiment of the seal cutting ring 22 used in the container 10 of FIG. 2, with a non-cutting section 24 that keeps the breached seal 20 from separating completely from the container 10 and thus falling into the finished mixed product. FIG. 3 also depicts the flexible seal 20 (e.g., made of HPDE, PET, LDPE, PE and/or other flexible materials) and an approximate standoff distance between the seal 20 and the cutting ring 22 before activation. It is expressly understood that this distance is less than the extent of compression of the contractible section 18, since the contraction is what brings both the seal 20 and the cutting ring 22 together. In sum, the cutting ring 22 in this embodiment includes several main characteristics: a welding surface area 26 for attachment to the container 10, a cutting section 28 that pierces and cuts the frangible seal 20, and a non-cutting section 24 that keeps the frangible seal 20 attached to the container 10 after the seal 20 is broken.

Figure 4:
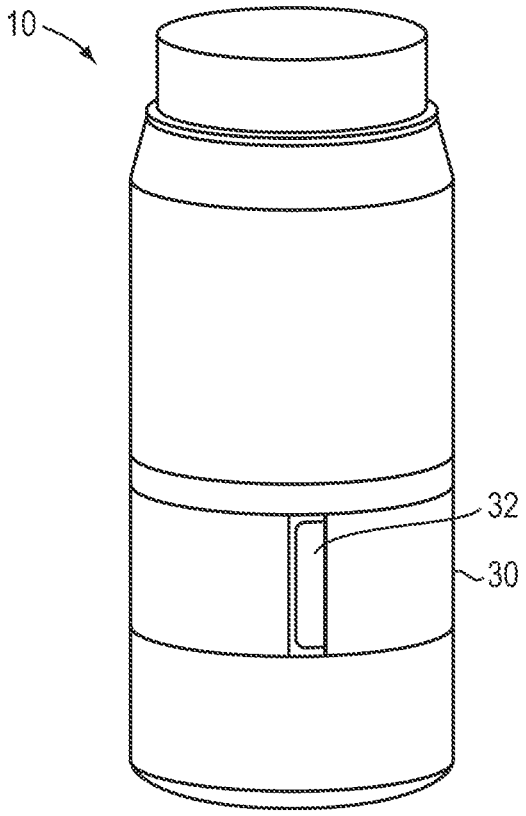
FIG. 4 is a schematic perspective view of the container of FIG. 1 with a safety seal in accordance with one embodiment of the invention.

FIG. 4 depicts one embodiment of the container 10 with an example of a safety seal 30 placed on top of the contractible section 18, to help secure the container 10 from inadvertent activation. To activate, the consumer may first release a section of the safety seal 30, for example, by tearing off a pull tab section 32. This permits the container 10 to be compressed, the seal 20 to be broken, and the contents to be mixed.

Figure 5:
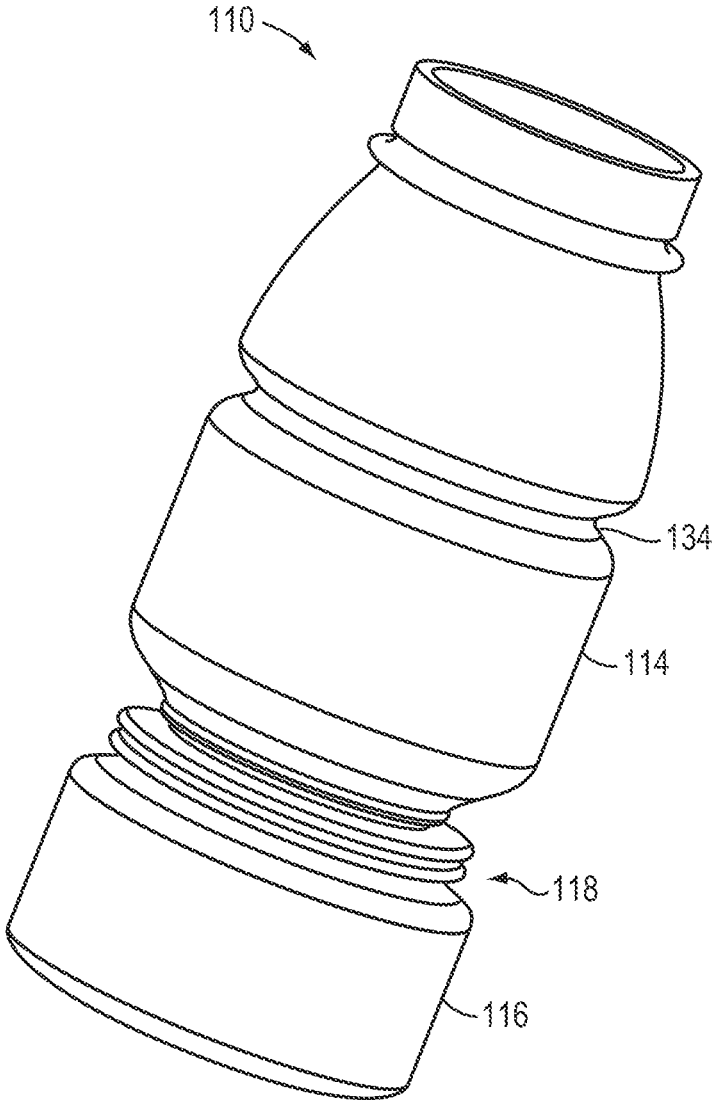
FIG. 5 is a perspective view of a container configuration in accordance with another embodiment of the invention.

FIG. 5 depicts another embodiment of a container 110 for use with beverages such as milk, juices, isotonics, and vitamin drinks for commercial applications. This configuration of the container 110 includes two different portions 114, 116, a frangible seal, a cutting ring, and a collapsible section 118. This configuration also includes an annular recessed groove 134 in the upper portion 114 for aesthetics, structural rigidity of the upper portion 114, and/or for accepting packaging rings for multi-container handling (e.g., six-pack rings).

Figure 6:
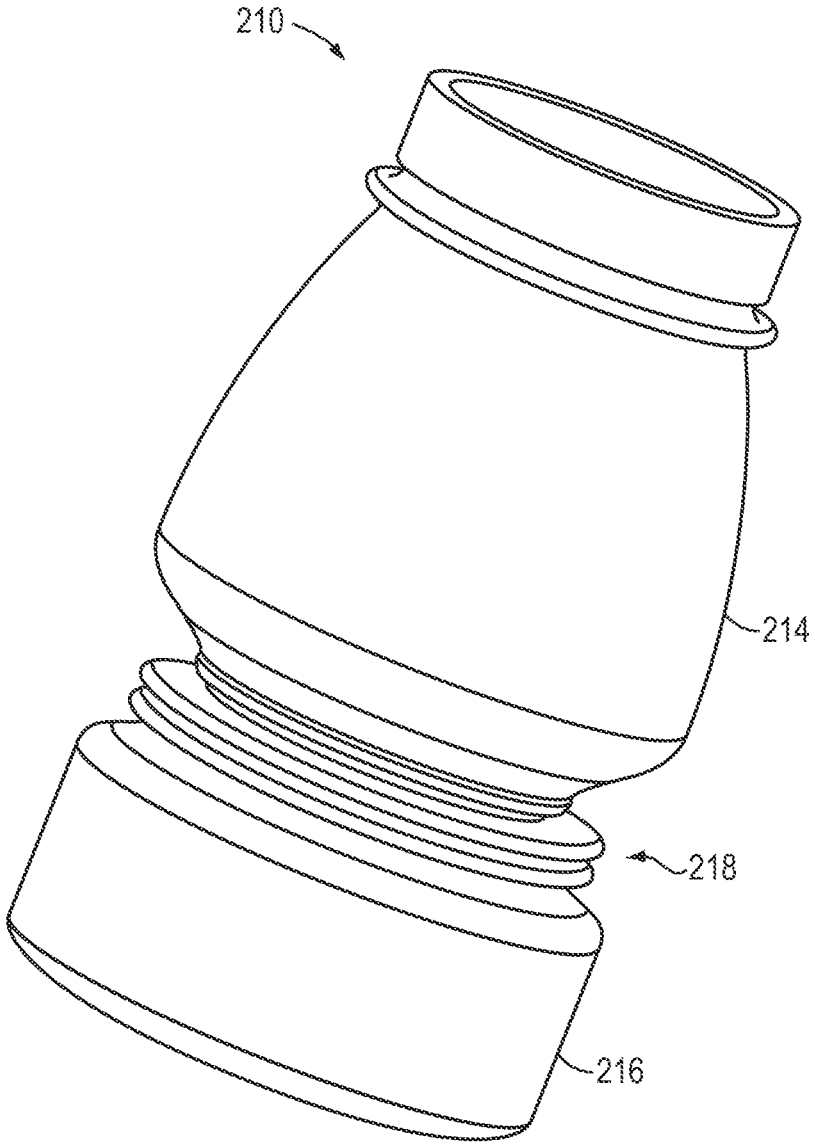
FIG. 6 is a perspective view of a container configuration for single serving beverages in accordance with an additional embodiment of the invention.

FIG. 6 depicts another embodiment of a container 210 in a specific bottle configuration for single serving beverages such as milk, juices, isotonics, and vitamin drinks for commercial applications. This container 210 also contains two portions 214, 216, a frangible seal, a cutting ring, and a collapsible section 218. One application is for rehydrating milk, although it is applicable to many other single serving beverage products.

Figure 7:
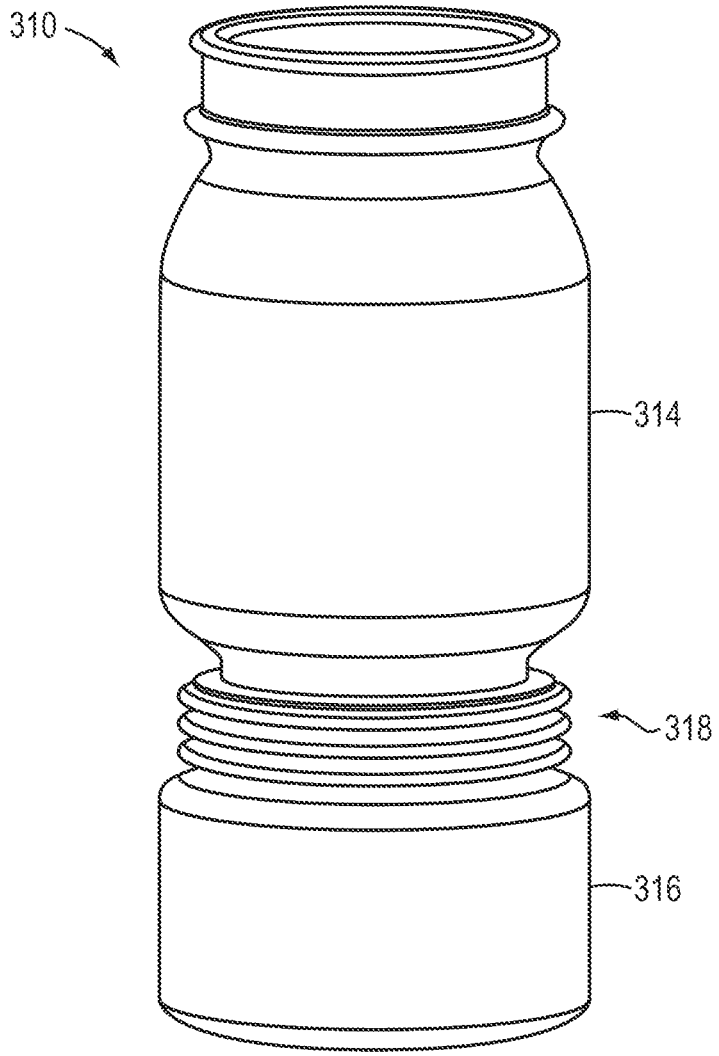
FIG. 7 is a schematic side view of a container in accordance with another embodiment of the invention.
Figure 8:
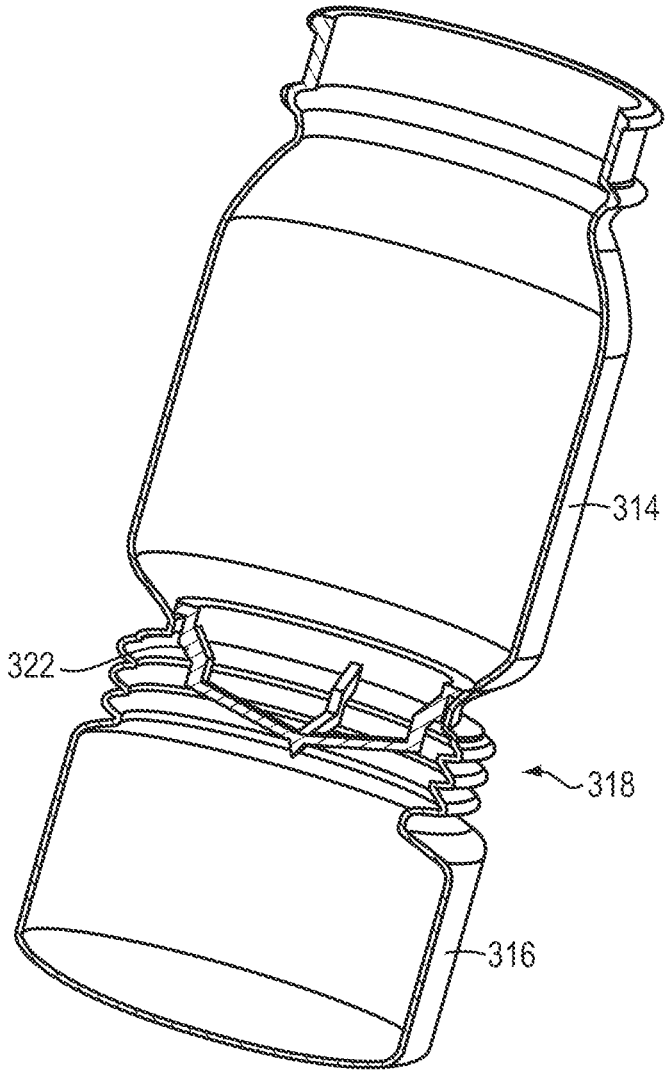
FIG. 8 is a schematic cross-sectional interior view of the container of FIG. 7 in accordance with one embodiment of the invention.
Figure 9:
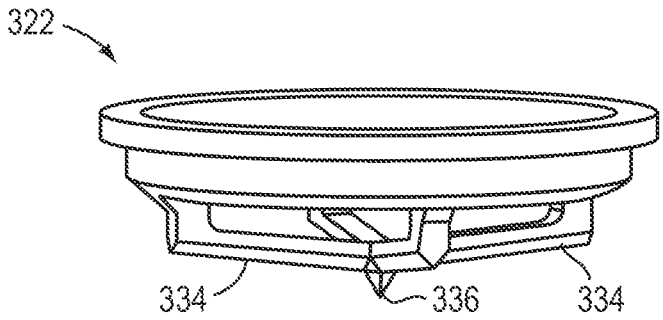
FIG. 9 is a perspective view of a piercing member for use with the container of FIG. 7 in accordance with one embodiment of the invention.

FIGS. 7-9 depict another embodiment of a container 310 with an alternative cutting mechanism 322. The container 310 includes several features as previously described, such as two portions 314, 316 and a frangible seal. The container 310 also includes an expanded collapsible section 318, depicted as three collapsible rings. The collapsible section 318 may have any number of rings, such as from two to five or greater. The collapsible section 318 may also be a single large collapsible ring, or other collapsible structure, capable of moving the cutting mechanism 322 to breach the seal. In embodiments where multiple rings are used, the rings may collapse within or against each other, allowing the collapsible section 318 to compress to a relatively short length compared to its uncompressed length. The greater the change in length, the further the cutting mechanism (or piercing member) 322 may be positioned away from the seal (helping prevent inadvertent premature seal penetration) and/or the further the piercing member 322 may extend through the seal (helping ensure sufficient seal penetration for mixing of the contents). The piercing member 322 may be generally centrally disposed within the container 310, and may be supported by a plurality of radially disposed edges 334. A pointed portion 336 of the piercing member 322 may extend below the edges 334, to initially penetrate the seal. The edges 334 may radially pierce the seal, creating open quadrants or seal flaps, providing a larger open interface for contents to mix.

Reconstituting milk powder for processing fluid milk, instead of using fresh fluid milk from the farms, is a very common practice for milk processors around the world. For packaging in refrigerated gable top cartons or aseptic, non-refrigerated multi-layered cartons, the convenience and many times lower cost of using milk powder on an industrial level makes it a popular choice among processors. By eliminating the whole thermal process and segregating the ingredients in the retail container, the present invention enables the end consumer to essentially "produce" a higher quality product at their convenience, and at a lower cost.

Aseptic or non-refrigerated products constitute a large portion of the beverage shelf in under-developed countries and emerging economies. However, paradoxically, the most expensive technology and packages have been the only alternative in their marketplaces. By eliminating the expensive side of production, including the most expensive carton package, the present invention delivers more natural nutrients at a much more competitive price. Moreover, regarding nutrients and vitamins, the present invention can deliver them intact, because they are not degraded by thermal processes or dilution before consumption.

A very practical and important application for this invention is to deliver freshly reconstituted milk to price sensitive markets in need of nutrition. By storing the proper proportions of milk powder and water in the separate sections within a single container, the consumer is able to receive practically all of the milk's nutritional value, even though the product could have been stored for extended periods of time (for weeks or even months without refrigeration). Since it is the consumer that essentially "produces" the beverage at his/her convenience, the need for high cost thermal processing and expensive packaging materials are eliminated. Furthermore, by eliminating the need for thermal processing such as UHT (ultra high temperatures), HTST (high temperature short time), and others, products are not exposed to high heat and therefore maintain most of their nutritional value intact.

There are many beverage applications for this type of packaging. Such applications include vitamin drinks that can contain up to 100% RDA of vitamins in juices, fortified nectars, isotonics, infant formula dispensers, instant milk shakes, instant soups, microwavable coffee, and even ice creams. However, there are many other applications for this invention outside the food industry. For example, chemical dispensers that can mix two or more substances for instant application like high bonding glues, instant forming gels, bio-degradable dispensers (i.e., where the container degrades after mixing its components), heating elements (i.e., where two chemicals are mixed to produce an exothermic heat reaction within the container), and many more. Also for the medical applications, containers can be designed for medicines that require mixing at the moment of use. Containers can even be designed to include needles or cannulas to provide injections or as IV "bags" that mix and deliver the proper dosage of medicine in a saline or other solution to the patient. This invention supplies the medical industry with new alternatives for dispensing known medicines and opens the door for many future applications.

The containers can be made in any volume (e.g., in volumes up to and including 375 ml, 750 ml, 1 liter, 1.5 liter, and greater) and may be subdivided into any suitable ratio of portions, depending on the components to be mixed. For two component containers, for example, the ratio of the first portion volume to the second portion volume may be less than or equal to about 1:10, 1:5, 1:4, 1:3, 1:2, 1:1, 2:1, 3:1, 4:1, 5:1, 10:1, or greater.

Example

Manufacturing and Processing Steps

Figure 10:
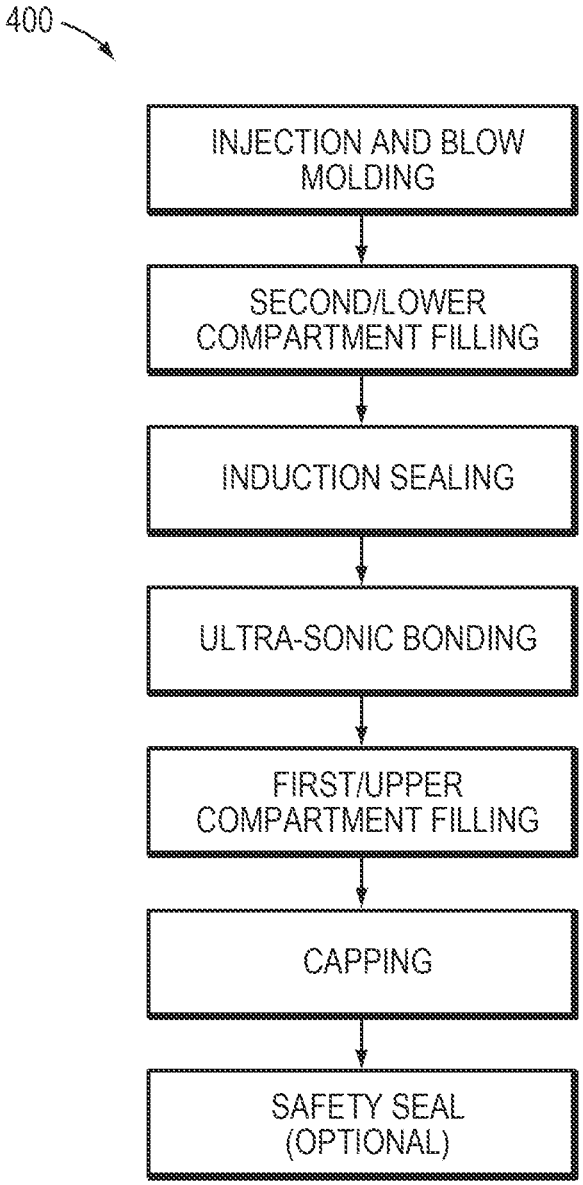
FIG. 10 is a schematic block diagram of a production line in accordance with one embodiment of the invention.

For a powdered milk and sterile water application and the associated industrialization of the present invention, a very basic production line 400 as depicted in FIG. 10 can include the following processes:

1. Injection and Blow Molding—Depending upon the specific volume and application of the product (e.g., milk, juice, or isotonic), the proper mold is placed in a multi-cavity injection molding machine. Plastic pellets of a single polymer or combinations thereof (e.g., HDPE, LDPE. PE, etc.) are heated and extruded to make a parison, which is then automatically portioned and placed in the center of the container mold. Air pressure is applied and the container is formed within the mold. It is then cooled, de-flashed and sent to the beginning of the filling line.
2. Second or Lower Compartment Filling—The first filling machine places the solid or liquid raw material (e.g., powdered milk or sterilized water) at the bottom portion of the container. The container with the first ingredient then travels to a second stage of the line.
3. Induction Sealing—An induction sealer places the flexible inner seal within the container, optionally applies a neutral gas to remove oxygen (depending upon the product), and secures the seal to the container's inner surface area that divides both compartments. The container then travels to a third stage.
4. Ultra-Sonic Bonding—An ultra-sonic welding machine places the cutting ring or piercing member along its surface area within the container and welds it to the interior of the container. The container then continues to travel to the fourth stage.
5. First or Upper Compartment Filling—A second filling machine fills the second ingredient (e.g., powdered milk or sterilized water) into the newly created upper portion or compartment. The container then continues to the fifth stage.
6. Capping—A capping or "capless" machine places a closure and/or liner at the discharge end of the container, thereby finishing the basic process. The container then continues to the seventh stage.
7. Safety Seal—A safety seal is optionally disposed around the "bellows" area, along the outside of the container. This safety seal secures the finished product, so to avoid inadvertent activation during transportation and/or handling. From this stage on, depending upon automation and other factors, the finished product can go to labeling, quality control check points, screening, cartoning, palletizing and warehousing.

This description of a basic production line only states the production requirements in general and depicts the typical equipment for beverages such as milk and other food products. However, for applications such as chemical or medical products, other equipment and set-up conditions may be required. It is expressly stated that any person of ordinary skill in the field of food processing understands that the type of equipment described in this example is readily available and in common use throughout the world. Moreover, the type of equipment used to place the inner seal and ultrasonically weld the cutting ring are presently in the marketplace, operating on a daily basis for hundreds of different applications. All such equipment can be adapted, according to the teachings herein, to manufacture various embodiments of the invention. In alternative embodiments, additional internal frangible seals and cutting rings can be added to create containers with three, four, or more compartments, for simultaneous or sequential breaching and mixing.

Various embodiments and features of the present invention have been described in detail with particularity. The utilities thereof can be appreciated by those skilled in the art. It should be emphasized that the above-described embodiments of the present invention merely describe certain examples implementing the invention, including the best mode, in order to set forth a clear understanding of the principles of the invention. Numerous changes, variations, and modifications can be made to the embodiments described herein and the underlying concepts, without departing from the spirit and scope of the principles of the invention. All such variations and modifications are intended to be included within the scope of the present invention, as set forth herein. The scope of the present invention is to be defined by the claims, rather than limited by the forgoing description of various embodiments. Accordingly, what is desired to be secured by Letters Patent is the invention as defined and differentiated in the claims, and all equivalents.

What is claimed is:

1. A container for delivery of segregated shelf stable components in a single chamber to a user, said container comprising:

a first container portion adapted to receive a first component;

a second container portion adapted to receive a second component;

a single frangible seal disposed between said first and second container portions in order to prevent inadvertent mixing of said first component and said second component;

seal breaching means comprised of a single cutting edge sharpened portion, actuated by displacement of the first container portion towards the second container portion;

wherein said container further comprises a flexible wall section joining said first container portion with said second container portion; and said flexible wall section comprises a bellows.

2. The invention according to claim 1, wherein;

said seal is affixed to said bellows.

3. The invention according to claim 2, wherein;

said single cutting edge is circumferentially disposed.

4. The invention according to claim 3, wherein;

said seal breaching means forms a discontinuity in the edge.

5. The invention according to claim 1, wherein;

said seal breaching means are comprised of a single cutting edge piercing member for puncturing said seal.

6. The invention according to claim 5, wherein;

said single cutting edge piercing member is generally centrally disposed.

7. The invention according to claim 6, wherein;

the piercing member is supported by a plurality of radially disposed edges.

8. The invention according to claim 1, wherein;

the seal breaching means is affixed to the first container portion and the central bellows are inverted so that both chambers are affixed with flexible walls and the center maintains itself solid.

9. The invention according to claim 1, wherein;

each of said first component and said second component is selected from the group consisting of liquids, gels, powders, granules, solids, and blends thereof after activation.

10. The invention according to claim 1, wherein;

a volume defined by the first container portion is substantially greater than a volume defined by the second container portion or vice-versa.

11. The invention according to claim 1, further comprising;

means to prevent breaching of the seal due to inadvertent displacement of the first container portion toward the second container portion.

12. The invention according to claim 1, wherein;

a section of the circumference of said single seal is secured through temperature changes in the sealing, special food grade glues, and/or similar methods, therefore securing said seal to the bottle; and said seal piercing is accomplished by the transferring of pressure from one chamber to the other.

13. The invention according to claim 12, wherein;

out of the 360 degrees of circumference, no more than 30 degrees are permanently affixed and welded.

14. The invention according to claim 11, wherein;

said seal is placed vertically in other embodiments where both chamber have flexible walls and said seal serves as a security measurement as well as the principal brand label.

* * * * *